US011802735B2

(12) United States Patent
Erno et al.

(10) Patent No.: US 11,802,735 B2
(45) Date of Patent: Oct. 31, 2023

(54) MULTI-BRANCH FURCATING FLOW HEAT EXCHANGER

(71) Applicant: Unison Industries, LLC, Jacksonville, FL (US)

(72) Inventors: Daniel Jason Erno, Niskayuna, NY (US); William Dwight Gerstler, Niskayuna, NY (US)

(73) Assignee: Unison Industries, LLC, Jacksonville, FL (US)

( * ) Notice: Subject to any disclaimer, the term of this patent is extended or adjusted under 35 U.S.C. 154(b) by 35 days.

(21) Appl. No.: 17/223,091

(22) Filed: Apr. 6, 2021

(65) Prior Publication Data

US 2021/0239401 A1 Aug. 5, 2021

Related U.S. Application Data

(63) Continuation of application No. 15/517,310, filed as application No. PCT/US2015/054115 on Oct. 6, 2015, now Pat. No. 10,995,996.

(Continued)

(51) Int. Cl.
*F28D 7/00* (2006.01)
*F28F 13/06* (2006.01)

(Continued)

(52) U.S. Cl.
CPC ..... *F28D 7/0008* (2013.01); *F28D 9/00* (2013.01); *F28D 9/0012* (2013.01); *F28D 9/02* (2013.01);

(Continued)

(58) Field of Classification Search
CPC ..... F28D 7/0008; F28D 9/00; F28D 9/0012; F28D 9/02; F28F 7/02
See application file for complete search history.

(56) References Cited

U.S. PATENT DOCUMENTS 6,221,463 B1 * 4/2001 White ..... B32B 3/26 55/440
10,209,009 B2 * 2/2019 Gerstler ..... F28D 15/04

(Continued)

FOREIGN PATENT DOCUMENTS

EP 1 777 479 A2 4/2007
EP 1 837 616 A2 9/2007

(Continued)

OTHER PUBLICATIONS

International Search Report and Written Opinion issued in connection with corresponding PCT Application No. PCT/US2015/054115 dated Jan. 22, 2016.

(Continued)

*Primary Examiner* — Gordon A Jones
(74) *Attorney, Agent, or Firm* — Dinsmore & Shohl LLP

(57) ABSTRACT

A heat exchanger is provided. The heat exchanger provides a first plurality of tubes and a second plurality of flow passages which furcate near one of the first and second manifolds into two or more furcated flow passages and subsequently converge to exit the heat exchanger. The plurality of furcated flow passages are intertwined, reducing the distance between flow passages containing each fluid therebetween to improve thermal transfer. Further, the furcations create changes of direction of the fluid to re-establish new thermal boundary layers within the flow passages to further reduce resistance to thermal transfer.

16 Claims, 12 Drawing Sheets

Related U.S. Application Data

(60) Provisional application No. 62/060,719, filed on Oct. 7, 2014.

(51) Int. Cl.

| | |
|---|---|
| ***F28D 9/00*** | (2006.01) |
| ***F28D 9/02*** | (2006.01) |
| ***F28F 13/00*** | (2006.01) |
| ***F28F 9/02*** | (2006.01) |
| ***F28F 7/02*** | (2006.01) |
| ***F28F 13/02*** | (2006.01) |
| ***F28F 21/08*** | (2006.01) |
| *F28D 21/00* | (2006.01) |

(52) U.S. Cl.

CPC ..... *F28F 7/02* (2013.01); *F28F 9/02* (2013.01); *F28F 9/0229* (2013.01); *F28F 9/0275* (2013.01); *F28F 13/00* (2013.01); *F28F 13/02* (2013.01); *F28F 13/06* (2013.01); *F28F 21/084* (2013.01); *F28F 21/086* (2013.01); *F28D 2021/0026* (2013.01); *F28F 2009/029* (2013.01); *F28F 2210/02* (2013.01); *F28F 2250/102* (2013.01)

(56) References Cited

U.S. PATENT DOCUMENTS

| | | | | |
|---|---|---|---|---|
| 2004/0039470 | A1 | 2/2004 | Gervasi et al. | |
| 2004/0251006 | A1* | 12/2004 | Marin | F28D 7/106 165/157 |
| 2006/0099074 | A1 | 5/2006 | Kopmels | |
| 2007/0062679 | A1 | 3/2007 | Agee et al. | |
| 2009/0101321 | A1 | 4/2009 | Ostersetzer et al. | |
| 2009/0274549 | A1 | 11/2009 | Mitchell et al. | |
| 2010/0091459 | A1 | 4/2010 | Zhang | |
| 2013/0139541 | A1 | 6/2013 | Seybold et al. | |
| 2013/0206374 | A1* | 8/2013 | Roisin | F28D 7/0041 165/165 |
| 2014/0251585 | A1* | 9/2014 | Kusuda | F28D 15/04 165/164 |
| 2016/0116222 | A1 | 4/2016 | Shedd et al. | |

FOREIGN PATENT DOCUMENTS

| | | | |
|---|---|---|---|
| GB | 2 310 896 | A | 9/1997 |
| WO | 2011/115883 | A2 | 9/2011 |
| WO | 2014/105113 | A1 | 7/2014 |

OTHER PUBLICATIONS

International Preliminary Report on Patentability issued in connection with corresponding PCT Application No. PCT/US2015/054115 dated Apr. 11, 2017.

Sotiropoulos et al. "Flow in Curved Ducts of Varying Cross-Section" F. Sotiropoulos and V. C. Patel, Iowa Institute of Hydraulic Research, Jul. 1992 (assessed on Jun. 16, 2018 online file:///C:/Users/gjones1/Documents/e-Red%20Folder/15517310/Sotiropoulos.pdf).

* cited by examiner

MULTI-BRANCH FURCATING FLOW HEAT EXCHANGER

CROSS REFERENCE TO RELATED APPLICATIONS

This application is a continuation of U.S. patent application Ser. No. 15/517,310 filed Oct. 6, 2015, which claims the benefit of PCT application PCT/US2015/054115 filed Oct. 6, 2015, which claims priority to and benefit from provisional application with Ser. No. 62/060,719 filed Oct. 7, 2014, entitled "MULTI-BRANCH FURCATING FLOW HEAT EXCHANGER", all of which is incorporated by reference herein.

BACKGROUND

The present innovations generally pertain to apparatuses, methods, and/or systems for improving heat exchange. More particularly, but not by way of limitation, the present innovations relate to multi-branch furcating flow heat exchangers, which may be used, for example, in a gas turbine engine, for fluid-fluid heat exchange wherein the fluid thermal boundary layers within the heat exchanger are continually re-established while minimizing pressure drop through the heat exchanger. As one skilled in the art will understand, while various embodiments are described relative to a gas turbine engine, the apparatus, methods and/or systems may also be used in various alternative applications where it is desired that heat be exchanged between two fluids.

In a gas turbine engine, air is pressurized in a compressor and mixed with fuel in a combustor for generating hot combustion gases which flow downstream through turbine stages. A typical gas turbine engine generally possesses a forward end and an aft end with its several core or propulsion components positioned axially therebetween. An air inlet or intake is located at a forward end of the gas turbine engine. Moving toward the aft end, in order, the intake is followed by a compressor, a combustion chamber, and a turbine. It will be readily apparent from those skilled in the art that additional components may also be included in the gas turbine engine, such as, for example, low pressure and high pressure compressors, and low pressure and high pressure turbines. This, however, is not an exhaustive list.

It is necessary to manage heat generation within the gas turbine engine so as not to raise gas turbine engine temperatures to unacceptable levels. For example, it may be desirable to control oil temperatures within the gas turbine engine which lubricates bearings associated with the high pressure shaft and/or the low pressure shaft. Further, during operation, significant heat is generated by the high pressure compressor which generates high temperature flow. Therefore, it may also be desirable to cool air exiting one or both of the high pressure compressor and the low pressure compressor.

In order to cool these fluids, various methods have been used however, improvements are still desirable. For example, improvement of parameters which are continually sought for heat exchangers include, but are not limited to, decreased weight, decreased volume, decreased pressure drop across the heat exchangers and decreased resistivity to thermal exchange. Additionally, it would be desirable to manufacture such heat exchanger in a manner which overcomes limitations associated with more commonly utilized manufacturing techniques.

The information included in this Background section of the specification, including any references cited herein and any description or discussion thereof, is included for technical reference purposes only and is not to be regarded subject matter by which the scope of the instant embodiments are to be bound.

SUMMARY

According to an embodiment, a heat exchanger (e.g., fluid-to-fluid) is provided. The heat exchanger provides a first plurality of flow passages and a second plurality of flow passages which extend from first and second manifolds, respectively. The plurality of flow passages include tubes which furcate near at least one manifold into two or more furcated flow passages and subsequently converge for joining near the at least one manifold. The plurality of furcated flow passages are intertwined, reducing the distance between flow passages containing each fluid therebetween to improve thermal transfer. Further, the furcations create changes of direction of the fluid to re-establish new thermal boundary layers within the flow passages to further reduce resistance to thermal transfer.

According to another embodiment, a heat exchanger comprises a first manifold defining a first fluid inlet, a second manifold defining a second fluid inlet, a first plurality of flow passages in flow communication with the first manifold, the first plurality of flow passages including a first fluid inlet and a plurality of first furcated flow passages extending from the first fluid inlet, a second plurality of flow passages in flow communication with the second manifold, the second plurality of flow passages including a second fluid inlet and a plurality of second furcated flow passages extending from the second fluid inlet, some of the plurality of first furcated flow passages joining and being in a first flow communication and some of the plurality of second furcated flow passages joining and being in a second flow communication, the furcated first plurality of flow passages and the furcated second plurality of flow passages intertwined to provide improved heat transfer.

According to yet another embodiment, a heat exchanger comprises a first fluid header and a second fluid header, a first plurality of flow passages in flow communication with the first header, the first plurality of flow passages including a first fluid inlet and a plurality of first furcated flow passages extending from the first fluid inlet, a second plurality of flow passages in flow communication with the second header, the second plurality of flow passages including a second fluid inlet and a plurality of second furcated flow passages extending from the second fluid inlet, some of the plurality of first furcated flow passages joining and being in a first flow communication and some of the plurality of second furcated flow passages joining and being in a second flow communication, the furcated flow passages changing direction and reducing thermal boundary within the flow passages, the furcated first plurality of flow passages and the furcated second plurality of flow passages intertwined to provide improved heat transfer, the first and second plurality of flow passages further in flow communication with a second and third fluid headers, respectively.

All of the above outlined features are to be understood as exemplary only and many more features and objectives of the apparatus, method and systems of the multi-branch furcating flow heat exchanger may be gleaned from the disclosure herein. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention is provided in the following written description of various embodiments of the invention, illustrated in the accompanying drawings, and defined in the appended claims. Therefore, no limiting interpretation of this Summary is to be understood without further reading of the entire specification, claims, and drawings included herewith.

BRIEF DESCRIPTION OF THE ILLUSTRATIONS

The above-mentioned and other features and advantages of these exemplary embodiments, and the manner of attaining them, will become more apparent and the multi-branch furcating flow heat exchanger will be better understood by reference to the following description of embodiments taken in conjunction with the accompanying drawings, wherein.

DETAILED DESCRIPTION

Figure 1:
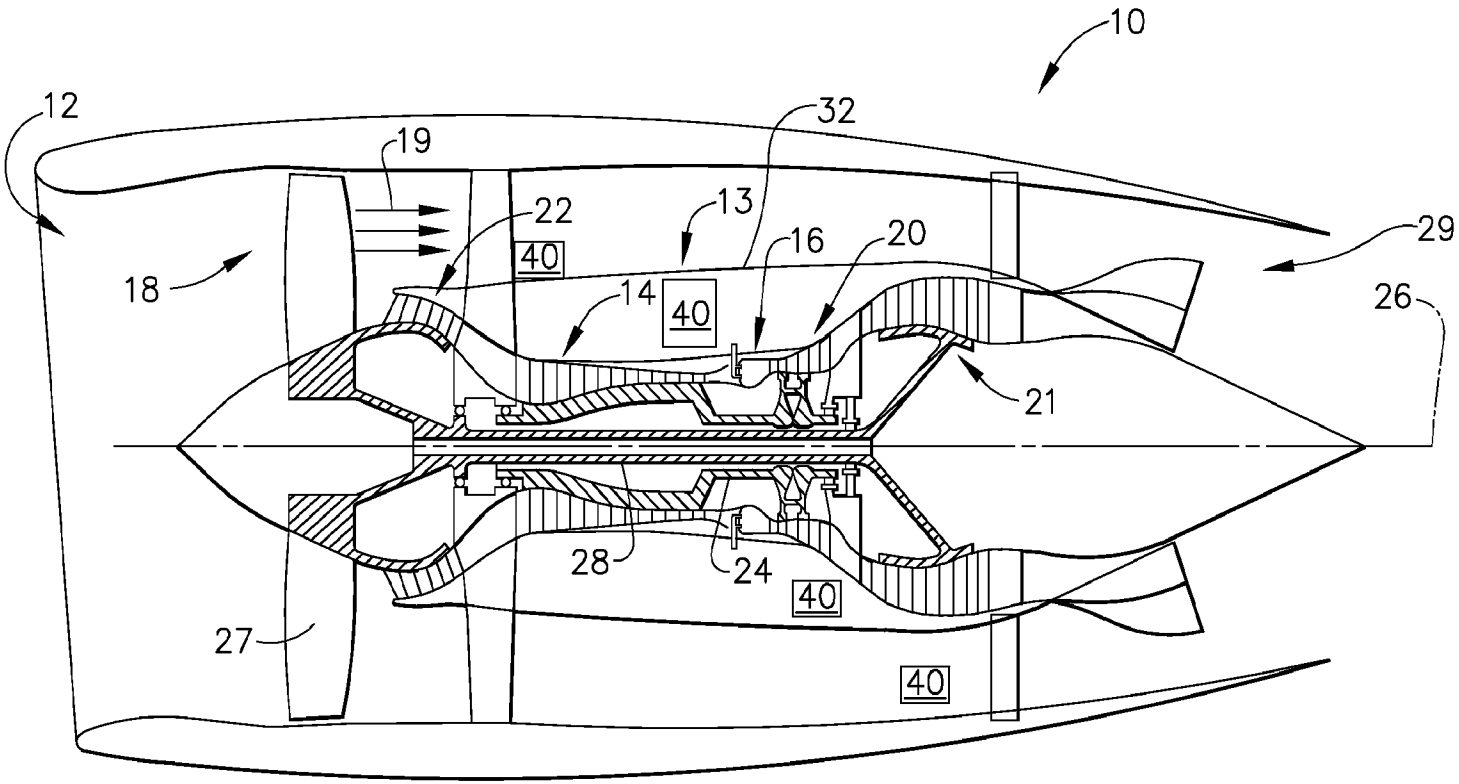
FIG. 1 illustrates an example schematic side view of an exemplary gas turbine engine in accordance with various aspects described herein.

Reference now will be made in detail to embodiments provided, one or more examples of which are illustrated in the drawings. Each example is provided by way of explanation, not limitation of the disclosed embodiments. In fact, it will be apparent to those skilled in the art that various modifications and variations can be made in the present embodiments without departing from the scope or spirit of the disclosure. For instance, features illustrated or described as part of one embodiment can be combined, integrated or otherwise used with additional or alternative embodiments to yield further embodiments. Thus it is intended that the present invention covers such modifications and variations as come within the scope of the appended claims and their equivalents.

Referring to FIGS. 1-16, various embodiments of multi-branch furcating flow heat exchangers are depicted. The heat exchanger provides a plurality of intertwined tubes or flow passages for first and second fluid flows to transfer thermal energy. The heat exchanger provides for improved thermal transfer, low weight, and low pressure drop. The heat exchanger furcated flow passages continually reset the thermal boundary layer in two ways. First, the thermal boundary layer is reduced within the flow passages by change of direction of the fluid flow within the flow passages. Further, the fluid flows also continually reduce the thermal boundary build up by dividing the flow into multiple paths therefore increasing heat transfer between the fluid flow passages.

As used herein, the terms "axial" or "axially" refer to a dimension along a longitudinal axis of an engine. The term "forward" used in conjunction with "axial" or "axially" refers to moving in a direction toward the engine inlet, or a component being relatively closer to the engine inlet as compared to another component. The term "aft" used in conjunction with "axial" or "axially" refers to moving in a direction toward the engine outlet, or a component being relatively closer to the engine outlet as compared to an inlet. As used herein, the terms "radial" or "radially" refer to a dimension extending between a center longitudinal axis of the engine and an outer engine circumference. The term parallel flow(s) as used herein, unless otherwise stated, means that the flow divides into two or more paths in moving between a first location and a second location. This is meant in contrast to the term serial which is generally defined as a single path between two locations. The term furcate as used herein means that a tube or fluid flow passage splits apart into two or more tubes, fluid flow passages or branches.

Referring initially to FIG. 1, a schematic side section view of a gas turbine engine 10 is shown having an engine inlet end 12 wherein air enters the core propulsor 13 which is defined generally by a multi-stage high pressure compressor 14, a combustor 16 and a multi-stage high pressure turbine 20. Collectively, the core propulsor 13 provides power for operation of the engine 10.

The gas turbine engine 10 further comprises a fan 18, a low pressure turbine 21, and a low pressure compressor 22. The fan 18 includes an array of fan blades 27 extending radially outward from a rotor disc. Opposite the engine inlet end 12 in the axial direction is an exhaust side 29. In these embodiments, for example, gas turbine engine 10 may be any engine commercially available from General Electric Company. Although the gas turbine engine 10 is shown in an aviation embodiment, such example should not be considered limiting as the gas turbine engine 10 may be used for aviation, power generation, industrial, marine or the like.

In operation air enters through the engine inlet end 12 of the gas turbine engine 10 and moves through at least one stage of compression in the low pressure compressor 22 and high pressure compressors 14 where the air pressure is increased and directed to the combustor 16. The compressed air is mixed with fuel and burned providing the hot combustion gas which exits the combustor 16 toward the high pressure turbine 20. At the high pressure turbine 20, energy is extracted from the hot combustion gas causing rotation of turbine blades 27 which in turn cause rotation of the high pressure shaft 24. The high pressure shaft 24 passes toward the front of the gas turbine engine 10 to cause rotation of the one or more high pressure compressor 14 stages and continue the power cycle. The low pressure turbine 21 may also be utilized to extract further energy and power additional compressor stages. The fan 18 is connected by the low pressure shaft 28 to a low pressure compressor 22 and the low pressure turbine 21. The connection may be direct or indirect, such as through a gearbox or other transmission. The fan 18 creates thrust for the gas turbine engine 10.

The gas turbine engine 10 is axi-symmetrical about centerline axis 26 so that various engine components rotate thereabout. An axi-symmetrical high pressure shaft 24 extends through the gas turbine engine 10 forward end into an aft end and is journaled by bearings along the length of the shaft structure. The high pressure shaft 24 rotates about the centerline axis 26 of the gas turbine engine 10. The high pressure shaft 24 may be hollow to allow rotation of a low pressure shaft 28 therein and independent of the high pressure shaft 24 rotation. The low pressure shaft 28 also may rotate about the centerline axis 26 of the engine. During operation the shafts 24, 28 rotate along with other structures connected to the shafts 24, 28 such as the rotor assemblies of the turbines 20, 21 in order to create power or thrust for various types of turbines used in power and industrial or aviation areas of use.

The gas turbine engine 10 further includes a multi-branch furcating flow heat exchanger 40. In the exemplary schematic view, the furcating heat exchangers 40 are shown in various locations for purpose of teaching. The furcating heat exchanger 40 may be utilized for a variety of fluid cooling functions including, but not limited to, liquid cooling and air cooling. In the instance of liquid cooling, it may be desirable to cool oil or other relatively higher temperature liquid lubricant with one or more relatively cooler temperature sources in the gas turbine engine 10. The oil may be cooled by air such that the cooling air is provided by a relatively lower temperature by-pass air flow 19. The axial location of the furcating heat exchanger 40 may also change depending on the fluid location to be cooled.

Further, the oil may be cooled by a liquid, for example fuel, which is often stored in wings and is exposed to the cold ambient conditions experienced at typical flight altitudes, for example. Therefore the relatively cooler temperature fuel may be used as the means for absorbing thermal energy from the relatively higher temperature cooling fluid or oil. In such embodiment, the furcating heat exchanger 40 may be positioned in a variety of locations, for non-limiting example as shown radially inward of an engine cowling 32. As with the previous embodiment, the furcating heat exchanger 40 may also be moved axially depending on the location of the, for example, fluid to be cooled.

In still further embodiments, the furcating heat exchanger 40 may be an air to air heat exchanger and may again be positioned in a variety of locations, for example in the by-pass air flow 19 so that the relatively cooler by-pass air flow 19 cools the relatively higher temperature compressor discharge air. Or according to other embodiments, the higher temperature compressor discharge air may be cooled by lower temperature air from the low pressure compressor 22. In this instance, the furcating heat exchanger 40 may be located within the engine cowling 32 or within the bypass air flow 19.

While gas-gas heat exchange is described according to some embodiments, according to other embodiments, gas-liquid heat exchange may also be within the scope of the instant disclosure. For example, the liquid may be sub-cooled, saturated, supercritical or partially vaporized. For example, the compressor discharge flow path may be cooled with water, water-based coolant mixtures, dielectric liquids, liquid fuels or fuel mixtures, refrigerants, cryogens, or cryogenic fuels such as liquefied natural gas (LNG) and liquid hydrogen. However, this list is not exhaustive and therefore, should not be considered limiting. Further, the lubricating fluids such as oil may be cooled in similar matters.

Thus, as depicted in FIG. 1, the furcating heat exchanger 40 may be positioned at a plurality of locations, some of which are shown in a non-limiting exemplary manner. The furcating heat exchanger 40 may also be used to cool fluids which are in a gaseous state or in a liquid state by other fluids which are in a gaseous state or a fluid state. In any of these embodiments, the furcating heat exchanger 40 utilizes a first fluid and a second fluid in close proximity which have parallel circuits between manifolds in order to cool at least one of the first and second fluids passing through the furcating heat exchanger 40.

Figure 2:
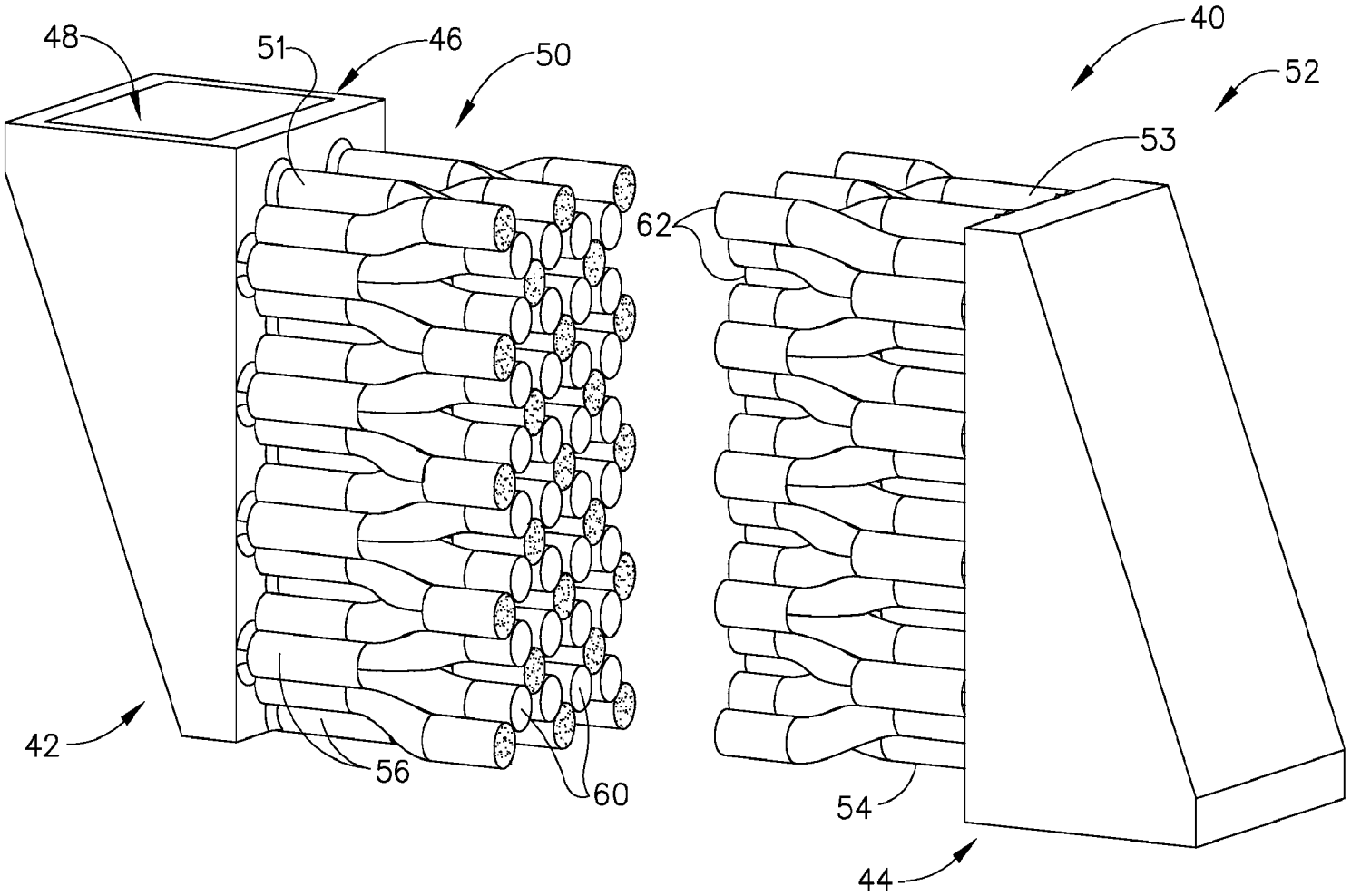
FIG. 2 illustrates an example isometric view of an internal flow domain of an exemplary heat changer which depicts the plurality of fluid tubes or flow passages in accordance with various aspects described herein.

Referring now to FIG. 2, an isometric view of two portions of the furcating heat exchanger 40 is depicted. The depiction shows a fluid domain defined by the flow paths or passages moving through the furcating heat exchanger 40 that are within a monolithic body or solid domain (not shown). Thus, while the flow passages are shown, these are fluid flows and may also be referred to as fluid flow passages moving through the solid domain or exterior structure defining the flow passages. The furcating heat exchanger 40 includes a first manifold 42 and a second manifold 44. Each manifold comprises at least two headers 46, 48 wherein the two fluids are collected for fluid communication with corresponding flow passages connected to the respective headers. The manifolds 42, 44 are depicted as being tapered which serves at least two purposes. First, the tapered design reduces volume of the furcating heat exchanger 40 which is desirable if the apparatus is used in the smaller confines of an aircraft engine, according to some embodiments. Second, the tapered design provides for optimized pressure distribution. This improved pressure distribution is desirable so as to limit pressure drop across the furcating heat exchanger 40.

Within each manifold 42, 44 is a header 46, 48 which serves as a conduit for the flows of relatively higher temperature fluid and relatively lower temperature fluid, respectively. The two flows of fluid may both enter from the first manifold 42 and exit at the second manifold 44. Alternatively, the two flows may enter from opposite manifolds 42, 44 and exit at the opposite manifolds 42, 44. As a still further alternative, the two flows may be both entering and exiting at both of the first and second manifolds 42, 44. Such embodiment may be provided through the addition of more headers within each manifold.

The furcating heat exchanger 40 may further comprise a first plurality of fluid tubes or fluid flow passages 50, 52. Although the tubes 50, 52 are shown, it should be understood that the depiction is of a fluid domain because the furcating heat exchanger 40 is monolithic in nature and the fluid flow passages are surrounded by metal (solid domain), having no distinct outer boundary or surface. Therefore, while the term "tube(s)" is used and shown, the tubes may interchangeably be referred to as "fluid flow passages" since the monolithic structure does not provide for a true tube outer surface as is common with known tubes. Each fluid flow passage 50 having the first fluid includes an inlet 51 and an outlet 53, while each fluid flow passage 52 having the second fluid includes an inlet 54 and an outlet 56. In the exemplary embodiment, the flows of fluids are described as entering the furcating heat exchanger 40 at opposite manifolds 42, 44 and exiting at opposite manifolds 42, 44, rather than both moving in the same direction. Either flow direction may be used but it is believed that improved heat exchange occurs when the fluid enters the furcating heat exchangers 40 at opposite ends.

The furcating heat exchanger 40 further comprises furcating fluid flow passages 50, 52. Specifically, each of the first fluid passages 50 extends from the first manifold 42 and furcates or split apart into two or more first furcated flow passages 60. Similarly, each of the second fluid flow passages 52 extends from the second manifold 44 and furcates or splits apart into two or more second furcated flow passages 62.

The first plurality of fluid flow passages 50 and second plurality of fluid flow passages 52 may comprise various cross-sectional shapes. For example, the depicted embodiment shows that the fluid flow passages 50, 52 have a circular cross-section. However, this is not to be construed as limiting as will be shown in further non-limiting examples wherein the flow passages may be square or skewed square/diamond shaped. Still further cross-sections may be utilized, however it may be desirable to maximize external contact surface area between the first plurality of fluid flow passages 50 and the second plurality of fluid flow passages 52 when determining cross-section shape. Further, it may be desirable to minimize distance between the first plurality of fluid flow passages 50 and the second plurality of fluid flow passages 52 which may otherwise provide resistance to thermal transfer between the first and second pluralities of fluid flow passages 50, 52. Additionally, it may be desirable to vary the cross-sectional area of the flow passages or maintain constant cross-sectional area of the flow passages. Still further, it may be desirable to vary the cross-section between the first and second flow passages. In other words, the tubes or flow passages need not have the same cross-section.

Figure 3:
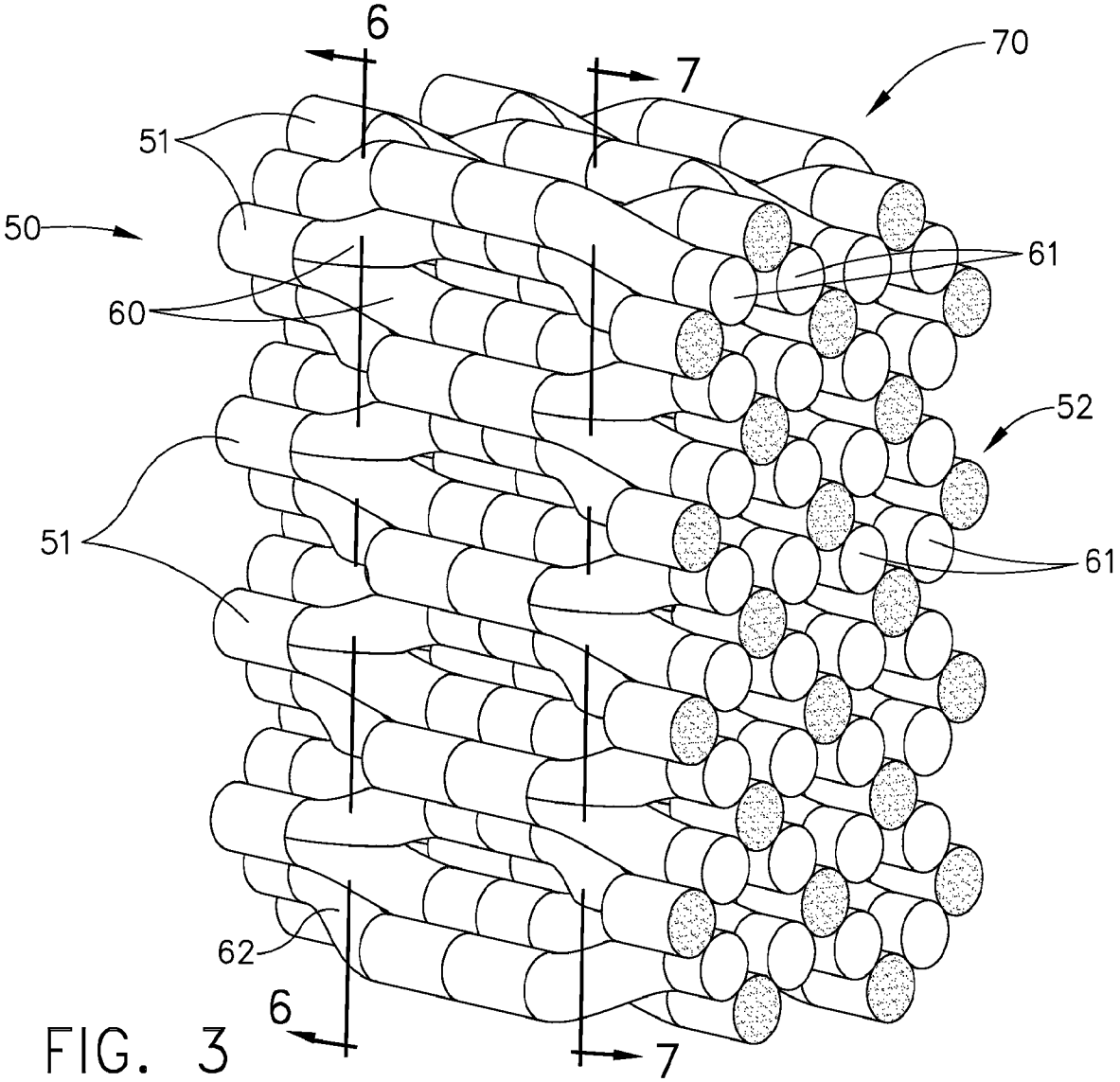
FIG. 3 illustrates an example isometric view of a plurality of furcated tubes in the heat exchanger core fluid domain, which is removed from the embodiment of FIG. 2 in accordance with various aspects described herein.

Referring now to FIG. 3, an isometric view of the heat exchanger core 70 provided as indicated by the fluid domain. The plurality of fluid flow passages 50, 52 also defines the heat exchanger core 70. In the heat exchanger core 70, the furcated flow passages 60, 62 from the first manifold side and the furcated flow passages 60, 62 from the second manifold side meet. In other words, the flow passages from the first manifold are in fluid communication with flow passages of the second manifold having the same fluid. Also shown at ends of the furcated flow passages 60, 62 are the inlet flow passages 51, 61. As shown at the sectioned end, the furcated flow passages 60 are intertwined with the furcated flow passages 62. Additionally, the continued furcation between adjacent furcated flow passages 60, 62 occurs in the heat exchanger core 70 before the furcated flow passages 60, 62 converge or rejoin to decrease near the opposite inlet flow passages 51, 61 of the second manifold 44.

Figure 4:
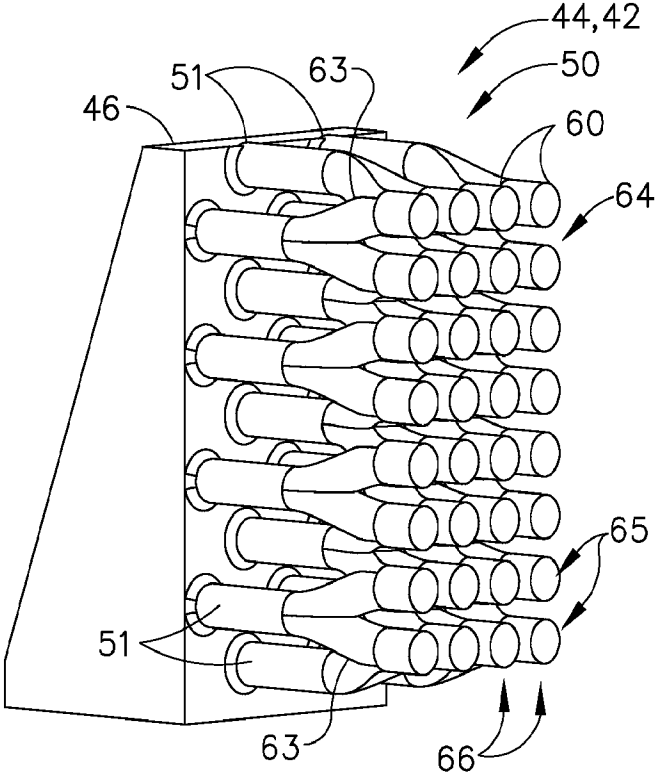
FIG. 4 illustrates an example isometric view of one header and first plurality of fluid flow passages defined by a fluid domain in accordance with various aspects described herein.

Referring now to FIG. 4, a perspective view of an exemplary manifold 42, 44 is shown again as indicated by fluid domain and with the flow passages exploded. Specifically, the manifold 42, 44 is represented by the header 46, for example including inlet flow passages 51 and furcated flow passages 60. In this view, only the first plurality of fluid flow passages 50 are shown, which provides easier description. The inlet flow passages 51 extend outwardly and may furcate vertically, in the exemplary orientation depicted, and/or may furcate in the horizontal direction. In the depicted embodiment, the furcated flow passages 60 form a pattern 64 of rows 65 and columns 66. Between each of the rows 65 is space for the second plurality of the fluid flow passages 52. The pattern 64 may be maintained throughout the furcating heat exchanger 40 or alternatively may be partially maintained. This means that some of the fluid flow passages 50 may form a pattern and others may not define the pattern. This may be desirable or necessary due to the shape of the volume being filled by the fluid flow passages 50, 52. The pattern 64 may be a two dimensional pattern or may be three dimensional.

Figure 5:
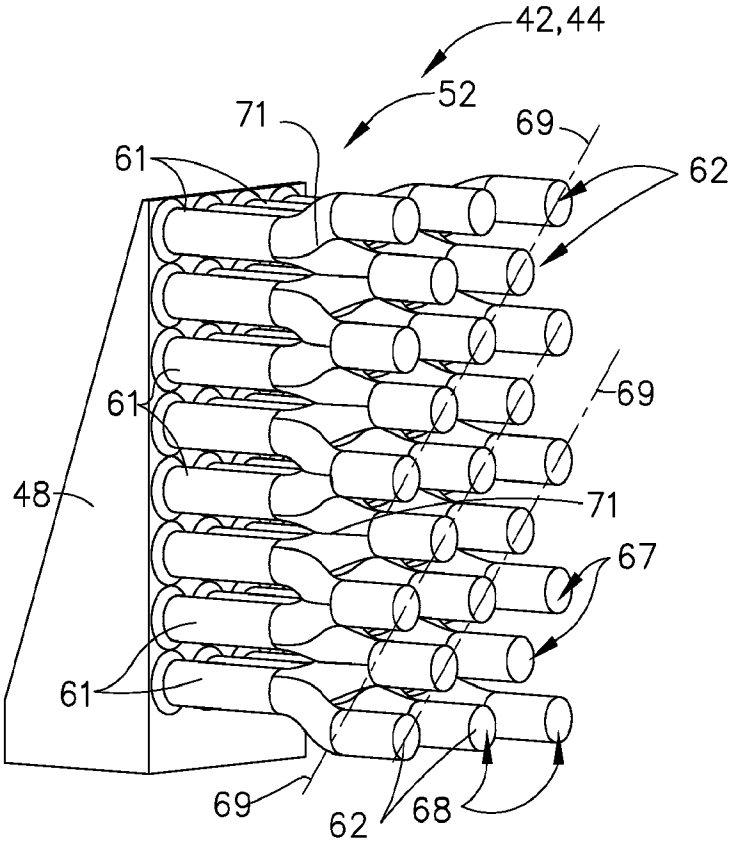
FIG. 5 illustrates an example isometric view of a second header and second plurality of fluid flow passages defined by a fluid domain in accordance with various aspects described herein.

Referring now to FIG. 5, a perspective view of the exemplary manifolds 42, 44 is embodied by the header 48 as indicated by the fluid domain also with the fluid passages exploded. The header 48 may fit within the header 46 (FIG. 4) but such construction is not limiting and may be embodied by alternate constructions. In this embodiment, the second plurality of fluid flow passages 52 are shown including inlet flow passages 61 and the furcated flow passages 62. The furcated flow passages 62 split into two or more flow passages from the inlet or outlet extending from the header 48. While the term "inlet flow passages" is used, it should be understood, as with inlet flow passages 51, that this inlet flow passage 61 may also be an outlet depending on which direction the flow of fluids comprises. That is, whether the two fluid flows are counterflows or flowing in the same direction. In other words, inlet flow passages 51, 61 connect to the furcated flow passages 60, 62 and may be either inlet or outlet.

In the exemplary embodiment of FIG. 5, the furcated flow passages 62 form patterns again defining a number of rows 67 and columns 68. The rows and columns 67, 68 are spaced apart so that the first plurality of fluid flow passages 50 may be disposed between the second plurality of fluid flow passages 52. The furcated flow passages 62 of this embodiment may not all be arranged to split apart vertically or horizontally as are the furcated flow passages 60. Instead, the furcated flow passages 62 may split apart on an angle to the vertical or horizontal. Specifically, the inlet flow passages 61 may be arranged vertically and horizontally as shown but the furcated flow passages 60, 62 may be embodied such that the furcated flow passages 62 are arranged on angles, as shown by the broken lines 69. Various angles may be utilized and according to some embodiments, may be about 45 degrees. The angle should not preclude the intertwining of the first plurality of fluid flow passages 50 and the second plurality of fluid flow passages 52. In such arrangement, the first and second plurality of fluid flow passages 50, 52 are intertwined and in contact for improved thermal transfer. The close contact of the fluid flow passages 50, 52 further aids to minimize volume of the furcating heat exchanger 40.

Additionally, with reference to both FIGS. 4 and 5, the plurality of fluid flow passages 50 have a further characteristic wherein the furcated flow passages 60 extend and join with adjacent furcated flow passages 60 at joinders 63. Similarly, the furcated flow passages 62 of the second plurality of fluid flow passages 52 also have joinders 71 wherein adjacent furcated flow passages 62 meet and allow flow communication therebetween. These joinders 63, 71 allow flow communication between adjacent furcated flow passages and provide parallel flow paths between the first manifold 42 and the second manifold 44.

The furcated flow passages 60, 62 extending from the inlet flow passages 51, 61 and the joinders 63, 71 between furcated flow passages 60, 62. These provide division of flow and changes of direction of the fluid flows providing the thermal heat exchange. In linear tubes, thermal boundary layers and momentum boundary layers build. However, the flow division and change of direction corresponding to the furcated flow passages 60, 62 and joinders 63, 71 provide reduction of these boundary layers. The reduction of these boundary layers reduces resistivity to thermal transfer thereby allowing improved thermal transmission. Unfortunately, the changes of direction and entrance region of effects also create pressure drop across the furcating heat exchanger 40. Therefore, acceptable pressure drops may be determined and number of direction changes be designed to stay within an acceptable pressure drop limit or range.

The furcating heat exchanger 40 may be formed in a variety of manners. A housing (not shown) may be formed substantially hollow wherein the manifolds 42, 44 and the plurality of fluid flow passages 50, 52 may be disposed therein. In other embodiments, the furcating heat exchanger 40 may be formed in monolithic forms and the manifolds 42, 44 may be formed integrally and the flow passages be formed integrally. The flow passages and/or monolithic formed housing may be formed of a high thermally conductive material. For example, an aluminum or aluminum alloy may be utilized or alternatively a casting alloy, copper casting alloy (C81500) or cast aluminum bronze (C95400) may be utilized. According to other embodiments, nickel-cobalt or nickel-cobalt alloys may be utilized. Still further, the plurality of fluid flow passages 50, 52 may be formed of, but are not limited to, incoloy alloy, INCONEL alloy, titanium-aluminide alloy, stainless steel alloy or refractory metals. It may be desirable to as closely match coefficient of thermal expansion (CTE) in order to reduce stress build up during production and operation of the different materials utilized for the fluid flow passages 50, 52. Desirable features for the materials utilized include outstanding resistance to fatigue and oxidation resistance or corrosion resistance from air or seawater. Additionally, pressure tight castings, incorporation into welded assemblies of cast or wrought parts, highly effective vibration damping and machinability and weldability are all desirable characteristics. While the above list of characteristics is provided, such is not limiting as various materials may be utilized for the matching of flow passage and body components.

Additionally, if differing materials are used to form the furcating heat exchanger 40, portions of dissimilar materials, metals for example, the furcating heat exchanger 40 may be coated with a diffusion barrier between dissimilar regions of metal. For example, the surface area of the plurality of fluid flow passages 50, 52 may be coated in a single or multi-layer process if such are formed of differing materials. According to one exemplary embodiment, a three layer coating process may be utilized wherein a first layer may comprise an electro-coated nickel bond coat followed by a second gold overcoat for adhesion of the third layer. The third layer might be established by a physical vapor deposition (PVD) of sputtered material such as titanium nickel or titanium stabilized with W, Pt, Mo, NiCr, or NiV. In either of these embodiments, the third layer is intended to function as a diffusion barrier preventing alloy depletion of the fluid flow passages 50, 52.

Although a number of examples are provided for material usage, one skilled in the art will recognize that this description is not limiting and other materials and combinations may be utilized as required by the application. Some parameters include, but are not limited to, temperature, pressure, chemical compatibility with the fluid, and coefficient of thermal expansion. This list is non-exhaustive and other materials and compatibility features may be considered. For example, other plastics, polymers and ceramics may be desirable for some aspects of the heat exchanger.

The manufacturing of the instant furcating heat exchanger 40 may occur in a variety of manners; however, one exemplary manufacturing technique can include additive manufacturing wherein the fluid flow passages 50, 52 are formed within a matrix body defining the furcating heat exchanger 40 using one or more materials. The aforementioned technique allows the materials to be joined during the manufacturing process.

Figure 7:
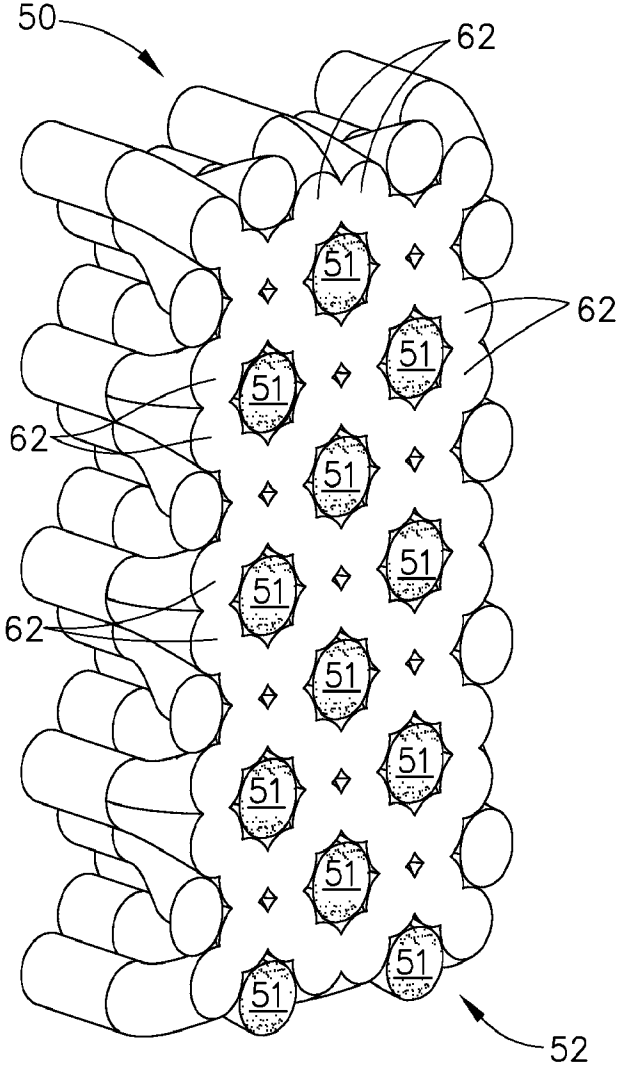
FIG. 7 illustrates an example isometric view of the first and second plurality of fluid flow passages sectioned at a second location in accordance with various aspects described herein.
Figure 6:
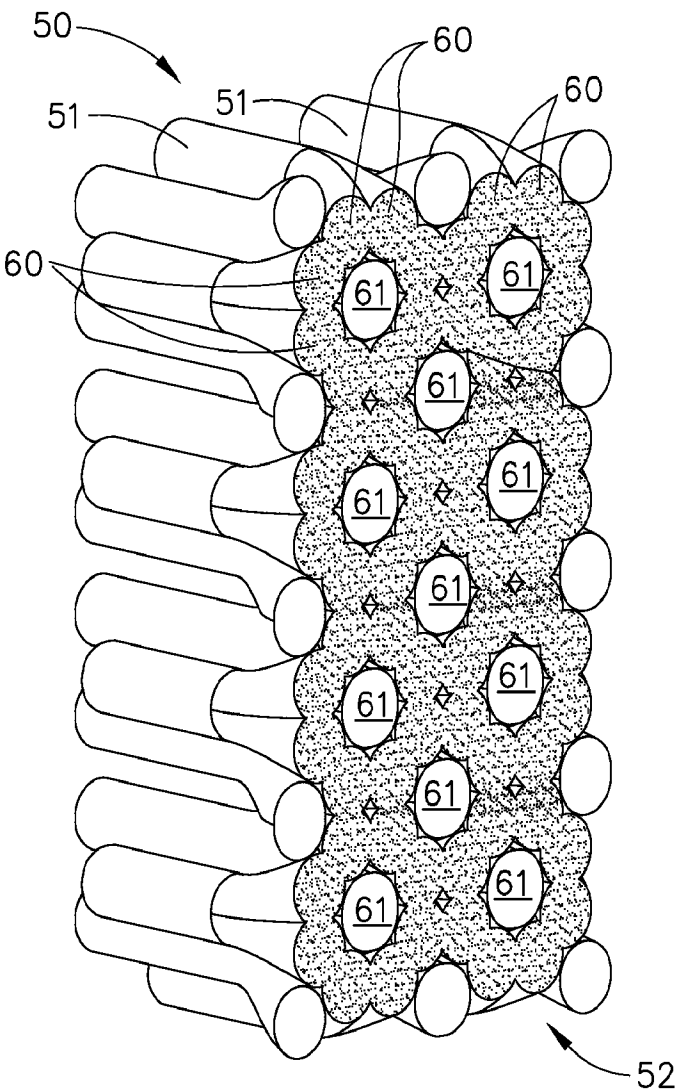
FIG. 6 illustrates an example isometric view of the first and second plurality of flow passages sectioned at a first location in accordance with various aspects described herein.

Referring now to FIG. 6, an isometric section is taken of the first plurality of fluid flow passages 50 and second plurality of fluid flow passages 52. The section cut is taken at a location shown in FIG. 3 and represents the fluid domain. As shown in the Figure, the furcated flow passages 60 are surrounding the inlet flow passages 61. In the view, the speckled furcated passages 60 represent the furcation of on fluid. The passages 61 alternatively represent the convergence of a second fluid which is surrounded by the first fluid passages for thermal exchange. As shown in the depicted section, the bifurcated flow passages 60 may form patterns wherein two or more flow passages join together. Also the section shows that the flow passages may be of same cross-sectional area or a related measurement referred to hydraulic diameter, measured as (4×area)/perimeter. As opposed to the views of FIGS. 3-5, wherein the cross-sections were taken at a point of symmetry wherein the fluid flow passages 50, 52 are both circular shaped, of the same diameter, and perfectly spaced, the cross-section of FIGS. 6 and 7 is taken at a location where the fluid flow passages 50, 52 are furcating such that the shape is no longer purely circular nor symmetric. However, the grouping of furcated flow passages 60 may be symmetric in that the group defines a pattern. It may also be desirable to vary the acceleration and deceleration of the fluid flow through the furcating heat exchanger 40 and this may be done by varying the cross-sectional area of the flow passages. Alternatively, where it is undesirable to vary the acceleration and deceleration, it may be desirable to provide a constant flow passage cross-section through the furcating process.

Referring now to FIG. 7, an alternate isometric section is taken of the first plurality of fluid flow passages 50 and the second plurality of fluid flow passages 52. The speckled passages 51 correspond to the speckled furcated passages 60 of FIG. 6 as these carry the same fluid. Alternatively, furcated passages 62 carry the same fluid as the passages 61 in FIG. 6. The passages 51 are surrounded as previously described. The furcated flow passages 62 are shown surrounding the inlet flow passages 51 so as to improve thermal transfer between the two fluids being carried therethrough. Again, the flow passages may be of same cross-sectional area or different cross-sectional area.

Figure 8:
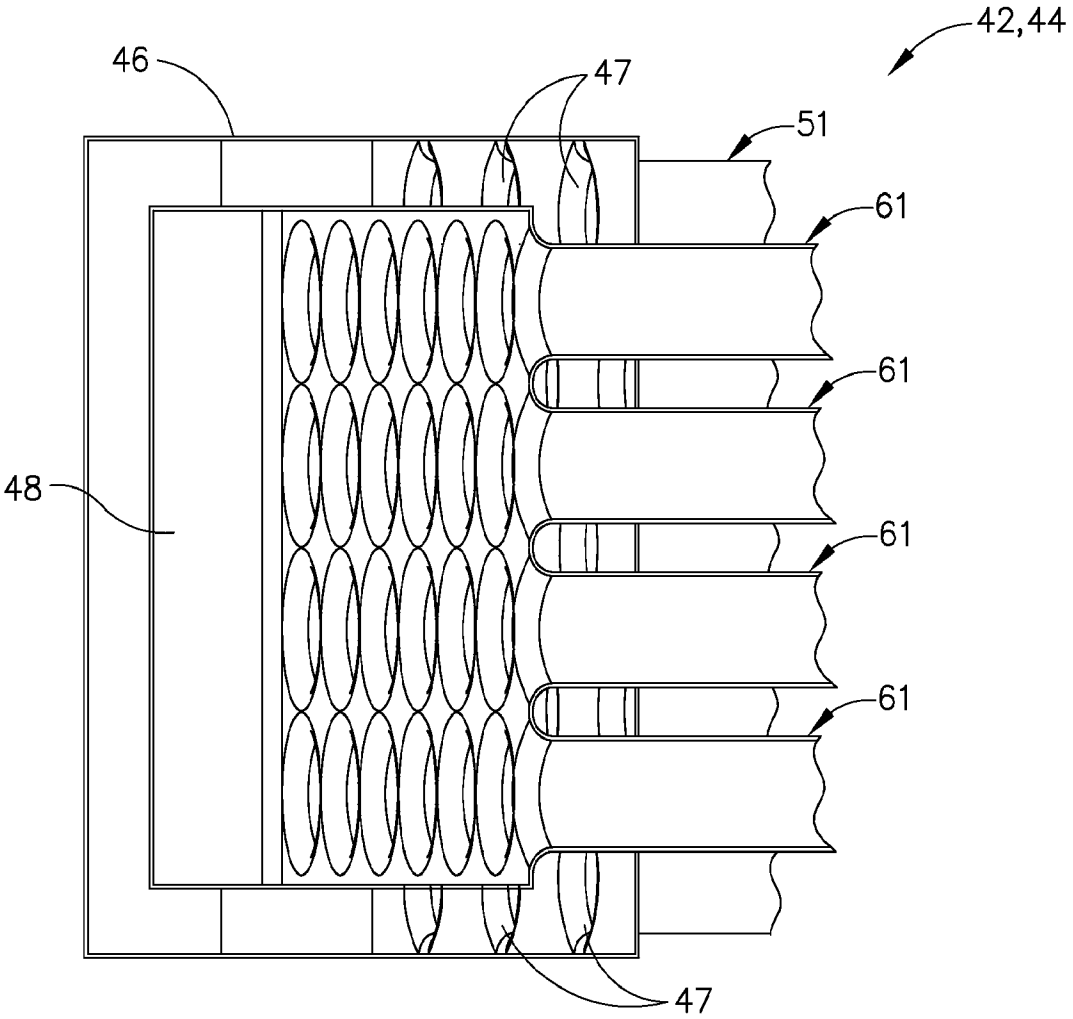
FIG. 8 illustrates an example section view of one manifold depicting the interface between the tubes for two fluids and one manifold wherein two headers for the two fluids are nested within the manifold in accordance with various aspects described herein.

Referring now to FIG. 8, a side section view of one of the manifolds 42, 44. The manifolds 42, 44 comprise the header 46 and header 48 corresponding to each fluid. The headers 46, 48 are nested within the manifolds 42, 44 according to the instant embodiment. As shown, the header 46 may include a plurality of radiused inlet holes 47 in flow communication with inlet flow passage 51. The radiused inlet holes 47 result in improved aero/hydro-dynamic entrance/exits at corners. This is measured by a pressure loss coefficient of entry $C_e$ which decreases when the corners are rounded as opposed to sharp or further when the inlet flow passages extend past the header walls. Additionally, the inlet flow passages 61 also pass through the header 46 and may include radiused inlets for improves hydro-dynamic performance. However such construction may be reversed if the headers 46, 48 are reversed relative to one another.

Referring now to FIGS. 9-16, an additional or alternative embodiment of a furcating heat exchanger 140 is depicted. In this embodiment, the furcating heat exchanger 140 has several differences compared to the previously discussed embodiments. First, the furcating heat exchanger 140 utilizes flow passages of an alternate cross-sectional shape than the previous embodiment. In the instant embodiment, the cross-sectional shape may be, for example, rectangular, square or skewed square, such as diamond shaped. However these shapes are not limiting as other shapes may be utilized wherein the outer contact surface of the flow passages is maximized for thermal transfer between fluids for relatively differing temperature. For example, while the rectangular, square or diamond cross-sectional shapes may be utilized, it may be that further embodiments include rounded corners to improve flow within the flow passages while also taking advantage of the contact surface previously described. Further, the angles between furcated flow passages differ. In the previous embodiment, the angles were more shallow, for example about 45 degrees. However, the angles of the furcated flow passages extending from the inlet flow passages are closer to 90 degrees in the instant embodiment.

Figure 9:
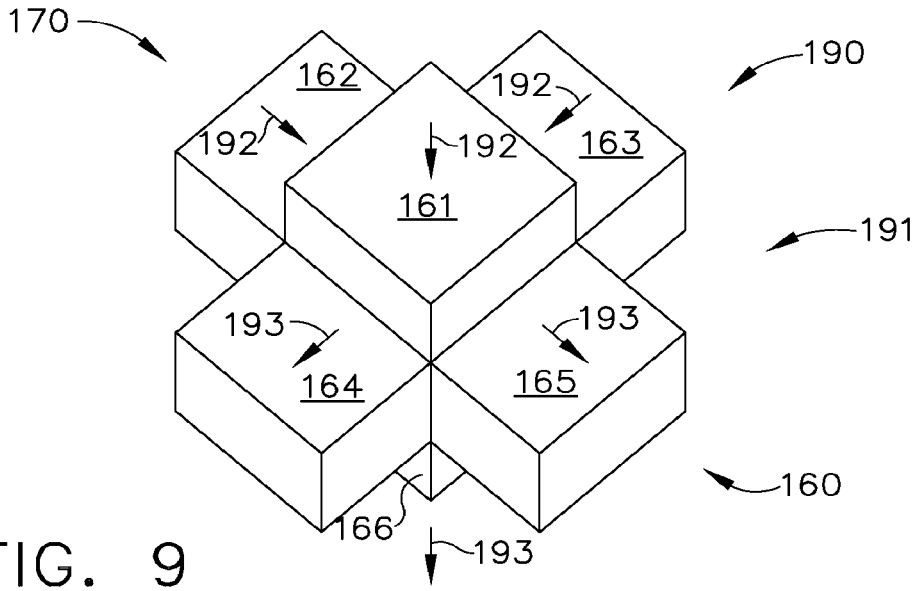
FIG. 9 illustrates an example isometric view of an alternative first plurality of furcated tubes or flow passages in accordance with various aspects described herein.
Figure 10:
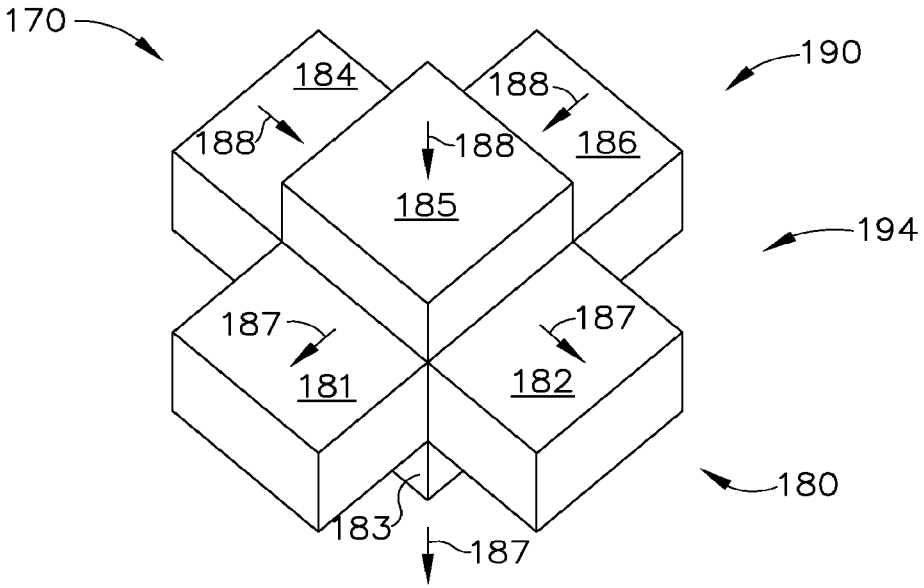
FIG. 10 illustrates an example isometric view of an alternative second plurality of furcated tubes or flow passages in accordance with various aspects described herein.

With reference now to FIGS. 9 and 10, the fluid domains are depicted for the two fluids passing through a unit cell 190. Referring first to FIG. 9, a unit cell 190 includes a first portion 191 and a second portion 194 (FIG. 10). Since this is the fluid domain, the depicted figure represents the flow passing through the heat exchanger core 170 through the flow passages rather than solid structure defining the flow passages. The unit cell first portion 191 corresponds to one of the first and the second fluid flows and the unit cell second portion 194 (FIG. 10) corresponds to the other of the first and second fluid flows. The unit cell 190 is located in the heat exchanger core 170 which is disposed between the manifolds and inlet flow passages. In these views the manifold and inlet flow passages are omitted as they will be connected to the heat exchanger core 170 in a manner similar to that which is previously described.

Figure 11:
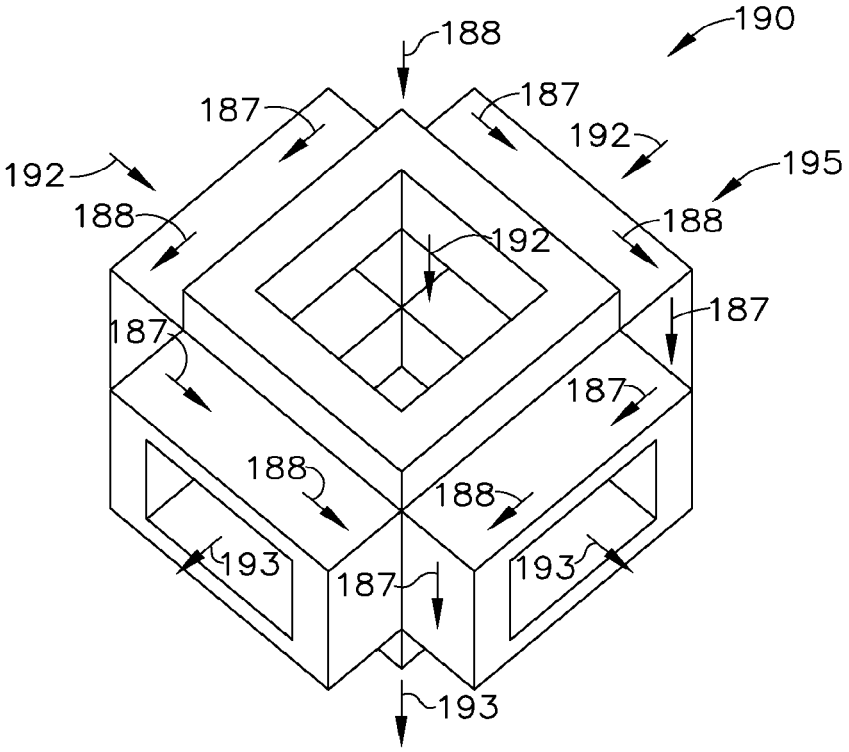
FIG. 11 illustrates an example isometric view of solid domain defining the unit cell and flow passages of FIGS. 9, 10 in accordance with various aspects described herein.

The unit cell first portion 191 includes a plurality of furcated flow passages 160 which furcate and intertwine with adjacent unit cell first portions 191 (FIG. 11). Thus the flow of either fluid is parallel, rather than serial, between the manifolds. In the previous embodiment, the furcated flow passages were furcated so that there were two or more split apart flow passages. The unit cells of that embodiment included at least one inbound fluid flow passages and at least two outbound fluid flow passages. In the instant embodiment, the furcated flow passages 160 are trifurcated so that three flow passages furcate or split away while three flow passages from one or more adjacent unit cell first portions 191 join the depicted unit cell 190.

The unit cell first portion 191 includes three furcated flow passages 161, 162, 163 (which are represented by the inbound flows 192) feed flow into the unit cell first portion 191. The inbound flows are shown as arrows 192. The unit cell first portion 191 also includes three additional furcated flow passages 164, 165, 166 (also represented by outbound flows 193) for outbound flow from the unit cell first portion 191. The outbound flows are shown as arrows 193. In this way, the flow of one unit cell first portion 191 is in flow communication with an adjacent one or more unit cell first portions 191.

When constructed, the plurality of furcated flow passages 160 of the unit cell first portion 191 are intertwined with the furcated flow passages 180 of the unit cell second portion 194 (FIG. 10). The unit cell second portion 194 is positioned for carrying the second fluid flow around and through, without fluid mixing, the first fluid for exchange of thermal energy. The cross-sectional shape of the furcated flow passages 160 provides for additional contact surface area with the unit cell second portion 194 to increase thermal conductivity between the fluid flows.

Referring now to FIG. 10, the unit cell second portion 194 is depicted in isometric view. Like the unit cell first portion 191, the unit cell second portion 194 has an architecture which has matching cross-sectional shapes with the unit cell first portion 191, so as to maximize contact between the furcated flow passages 160, 180 and improve thermal energy transfer. As with FIG. 9, the depiction of FIG. 10 is of the fluid domain of the second fluids, and therefore the furcated flow passages 180, are represented by the fluid flows.

The furcated flow passages 180 include a trifurcated arrangement similar to the unit cell first portion 191. The furcated flow passages 180 include three furcated flow passages 181, 182, 183 through which outbound fluid flows. In the exemplary embodiment, these provide a conduit for outbound fluid flow 187 from the unit cell second portion 194. The unit cell second portion 194 also includes three furcated flow passages 184, 185, 186. These flow passages provide a conduit for inbound fluid flow 188.

Referring now to FIG. 11, an isometric view of a solid domain 195 is depicted for the single unit cell 190. The solid domain 195 defines the solid structure about or through which the first and second fluids flow but are maintained separately. Thus in this figure, the solid material is depicted as opposed to the fluid flows as in FIGS. 9 and 10. As may be gleaned from comparison with FIGS. 9 and 10, the flow passages, indicated by furcated flow passages 160 are adjacent to furcated flow passages 180 depicted in FIG. 10, which may be better understood by viewing FIGS. 11 and 12.

The solid domain 195 is shown with a plurality of arrows disposed about the solid domain 195 that depict the various fluid flows of FIGS. 9 and 10. In the depicted embodiment, there are three inbound flows and three outbound flows for each of the first and second fluid flows. The unit cell first portion 191 flow is shown comprising the inbound flows 192 in three inbound orientations relative to the unit cell 190. Additionally, there are three outbound flows 193 of the first fluid flow. One skilled will understand that the unit cell first portion 191 shown in FIG. 9 conforms to the solid domain 195 of FIG. 11.

Additionally, the arrows of the unit cell second portion 194 (FIG. 10) are provided in FIG. 11 representing the second fluid flow about the unit cell solid domain 195. The second fluid flow comprises the inbound flows 188 and the outbound flows 187. As shown, the intersections of the walls of the solid domain defines intersections of fluid wherein there are either two inbound flows 188 and one outbound flow 187 or alternatively there are two outbound flows 187 and one inbound fluid flow 188.

With this unit cell 190 defined, additional unit cells are formed to define a larger heat exchanger core. For example, with reference to FIG. 12, eight unit cells 190 are shown formed together and defining the solid domain. First, one skilled in the art will understand that the complicated nature of the geometry may require different forms of manufacture. For example, the depicted embodiment may be formed by additive manufacturing techniques which allow for the more complicated geometries of the instant embodiment. Each of the unit cells 190 is separated by a broken line for purpose of distinguishing in the Figure.

One skilled in the art will realize that the ratios of hydraulic diameter or areas for the fluids is 1 to 1 since the flow passage 160, 180 are equivalent. However, these ratios may be varied by changing the cross-sectional area of the one fluid passage relative to the other fluid passage. This may be optimized for flow requirements, such as flow rate, pressure drop and heat transfer. Also this may be optimized for a given space wherein the heat exchanger 170 will be positioned.

Figure 12:
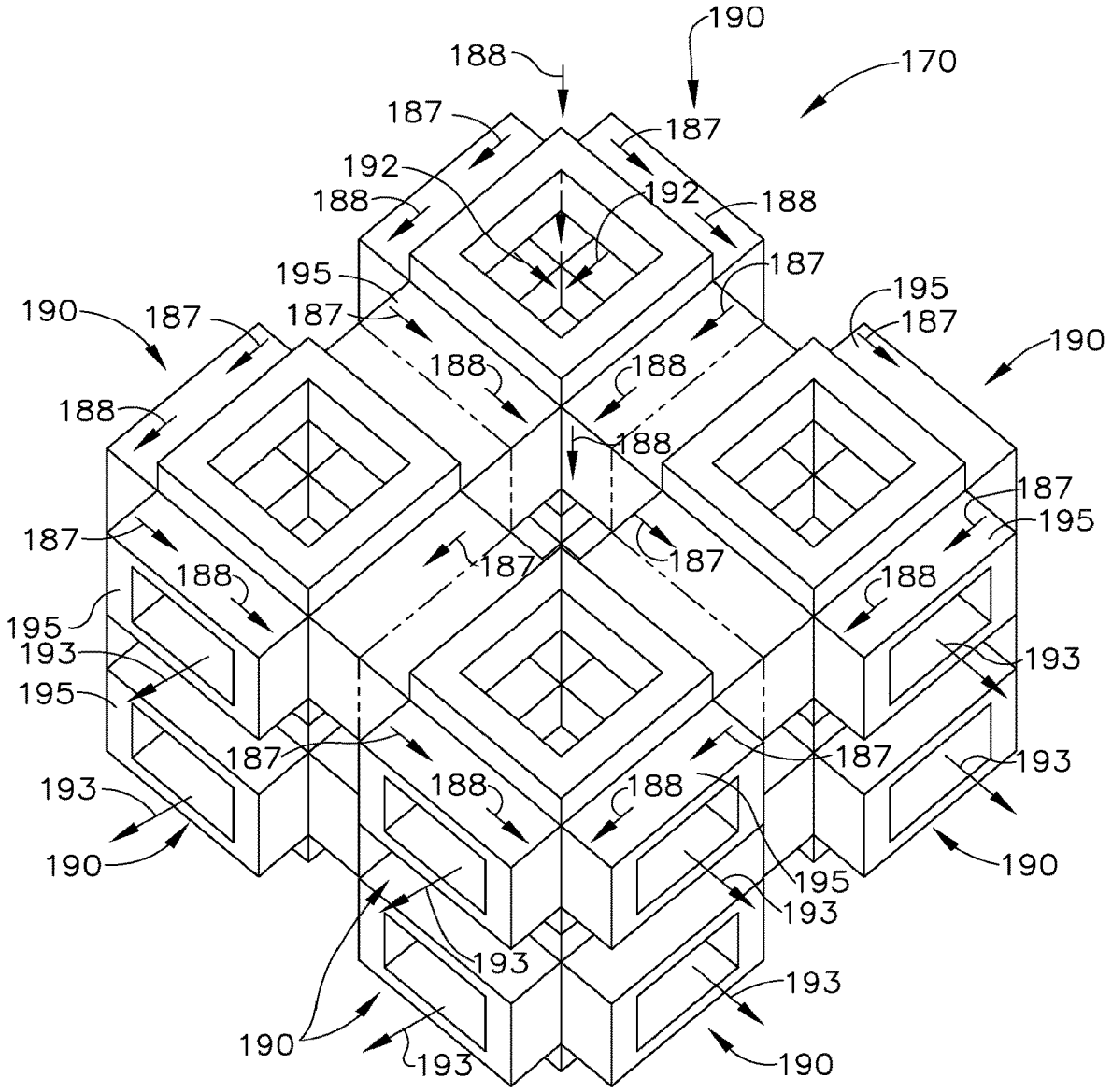
FIG. 12 illustrates an example exemplary pattern formed by eight unit cells defined by the intertwined furcated tubes or flow passages of FIG. 11 in accordance with various aspects described herein.

Referring still to the embodiment of FIG. 12, the portion of the heat exchanger depicted is formed of eight unit cells 190. The unit cells 190 each allow flow corresponding to the unit cell first portion 191 (FIG. 9). With the eight cells joined as shown, the flows of the unit cell first portion 191 of each unit cell 190 are in fluid communication. As discussed with respect to FIGS. 9 and 11, the unit cell first portion 191 comprises inbound and outbound flows 192, 193. Similarly, as discussed with respect to FIGS. 10 and 11, the unit cell second portion 194 is separated from the unit cell first portion 191 by the solid domain 195 and the second unit cell second portion 194 comprises inbound flows 188 and outbound flows 187. The terms inbound and outbound are used relative to the unit cells 190 or the intersections of adjacent unit cells 190. Accordingly, the numbers 187, 188 are positioned close to the intersections to indicate inbound or outbound flow from the adjacent intersection.

In this view, one skilled in the art will also better understand how the flows of the unit cell first portion 191 and the unit cell second portion 194 are intertwined. The unit cell first portion 191 for example may flow through the interior of each solid domain 195. Further, the unit cell second portion 194 may be positioned along the exterior surfaces of the solid domain 195. In this way, the two flows represented by portions 191 and 195 are separated and do not become mixed. Further, since the flows are on both sides of the depicted solid domain 195, the heat transfer is improved.

The depicted view shows that the fluid flows are continually changing direction which continually resets the fluid boundary layers and therefore also improves heat transfer. In this view, it is clear that the fluid flows are changing direction in a zig-zag or saw-tooth pattern so that boundary layers are limited and so that turbulent flow is also created, which aids in heat exchange between the fluid flows. The unit cell first portion 191 and the unit cell second portion 194 are intertwined or otherwise formed so as to intertwine or weave together. The flat surfaces of the plurality of furcated flow passages 160 and the plurality of furcated flow passages 180 are in contact to aid improved thermal transfer and the flat exterior surfaces maximize contact surface area.

Figure 16:
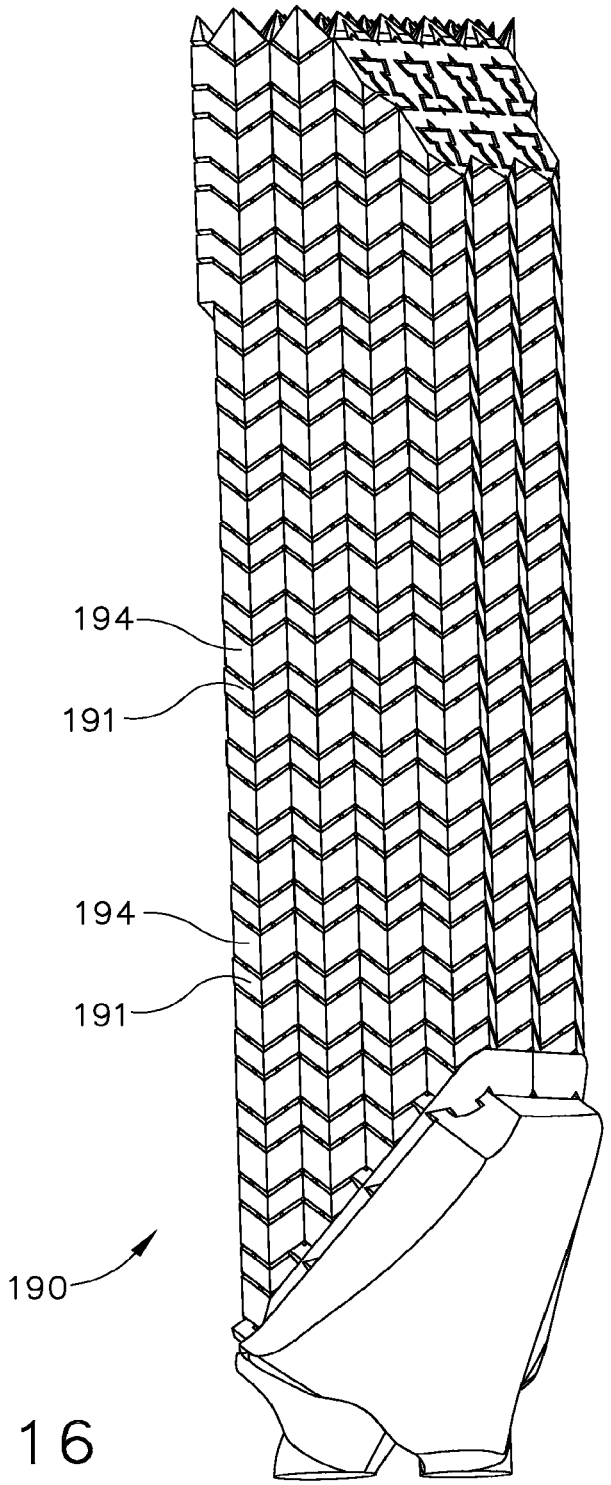
FIG. 16 is a side elevation view of the fluid domain with heat exchanger core in accordance with various aspects described herein.

With this limited construction in mind, and with additional reference to FIG. 16, the heat exchanger core 170 is shown comprising a plurality of unit cells 190 in fluid domain form. This shape may be formed in various patterns to include repeating patterns in full or in part depending on the volume shape wherein the heat exchanger core 170 will be located. The unit cells 190 are comprised of the flows of the depicted unit cell first portions 191 and the unit cell second portions 194. Further however, the cross sectional shape and area of the furcated flow passages may be of constant cross-sectional shape or may be of varying cross-sectional shape. Further, one skilled in the art will also recognize that the furcations within the plurality of furcated flow passages 160, 180 are angled as compared to the rounded or curved furcations of the previous embodiment. Moreover, the angles provide for sharper changes of direction than the previous embodiment.

Figure 13:
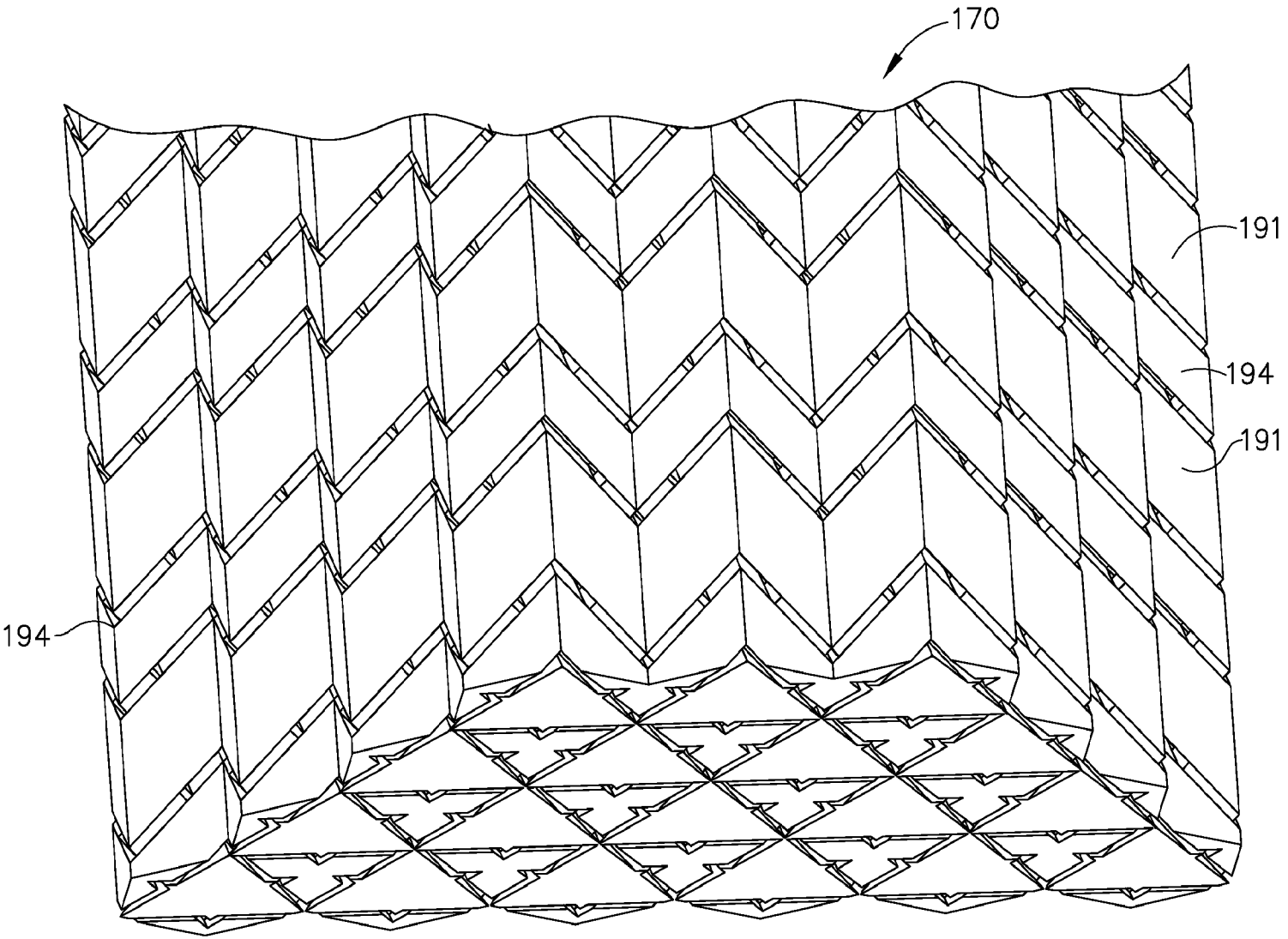
FIG. 13 illustrates an example isometric view of the fluid domain defined by the furcated flow passages of a heat exchanger core in accordance with various aspects described herein.

Referring now to FIG. 13, an isometric view of a portion of the heat exchanger core 170 fluid domain is depicted comprised of multiple unit cells 190 (not seen due to the fluid). In this view, the flows of the unit cell first portions 191 and the unit cell second portions 194 are shown. The continual change of direction of the fluid is clearly shown in this view. As previously described, the change of direction fluids reduces or resets thermal boundary layers. In turn, this reduces resistance to thermal transfer and improves heat exchange between the first fluid and the second fluid. In this view, the continual direction change and the furcating of the flow passages defining the unit cell first and second portions 191, 194 of the fluids improves thermal exchange as described.

While various techniques may be used to construct the heat exchanger core 170, it may be desirable that the present embodiments, or variations thereof, be manufactured using additive manufacturing techniques. This limits the number of brazed or welded joints which in turn reduces the likelihood of leakage within the device. Additionally, the additive manufacturing technique allows for more complex geometries such as that of the instant embodiment and formation of such while limiting joints.

Figure 14:
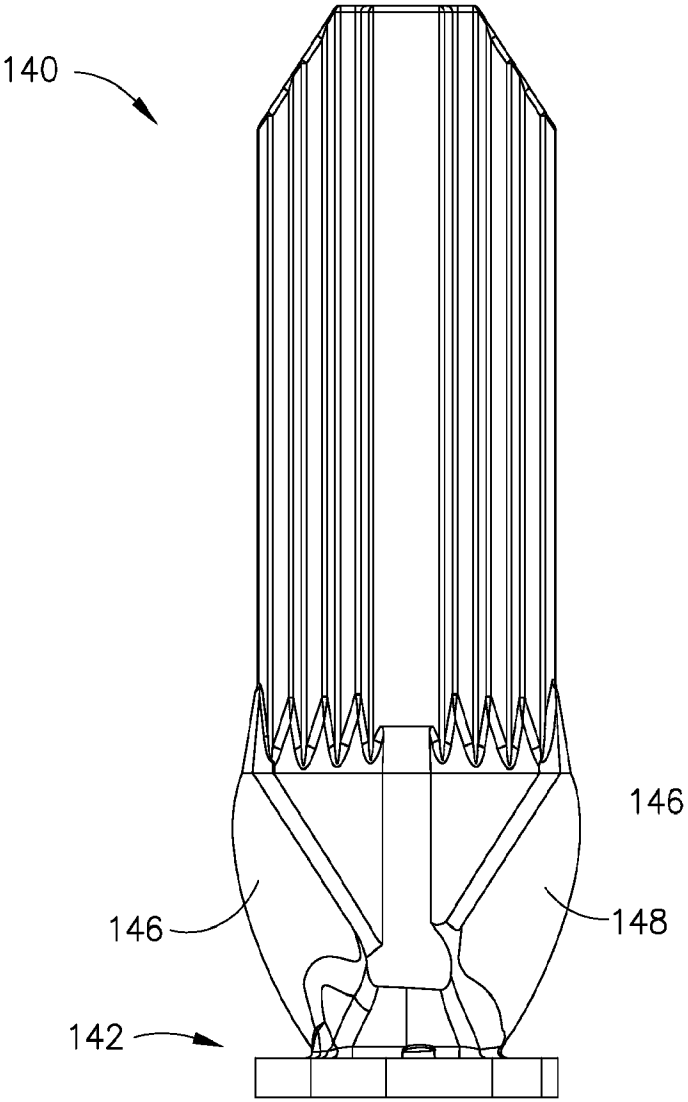
FIG. 14 illustrates an example side elevation view, depicting the solid domain, of the heat exchanger, in accordance with various aspects described herein.

Referring now to FIG. 14, a side elevation view of one embodiment of the furcating heat exchanger 140 is depicted. The figure shows the exterior or solid domain monolithic furcating heat exchanger 140. Again, the solid domain defines the solid structure wherein the furcated flow passages 160, 180 are formed for fluid flow of the two fluids exchanging thermal energy. As shown in the side elevation view, the exterior sides of the furcating heat exchanger 140 comprise the zig-zag pattern of the furcated flow passages 161-163 and 181-183.

Additionally, in this embodiment, a manifold 142 is defined at one end of the heat exchanger so that the two or more headers 146, 148 are also disposed at one end of the furcating heat exchanger 140. Thus, as opposed to the previous embodiment where the fluids entered and exited the furcating heat exchanger 40 at opposite ends, in the instant embodiment the fluids may enter and exit at the same end of the furcating heat exchanger 140. Additionally, while a first and second header is shown, the embodiment may include third and fourth headers which are not shown so that a header exists for input and output for each of the two fluids.

Figure 15:
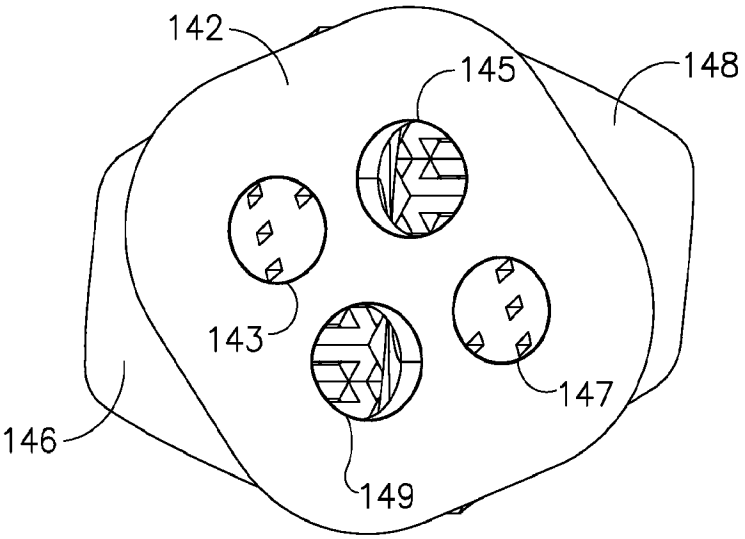
FIG. 15 illustrates an example bottom view of the heat exchanger illustrated in FIG. 14 in accordance with various aspects described herein.

Referring still further to FIG. 15, a bottom view of the manifold 142 area of the furcating heat exchanger 140 is depicted. As discussed above, the manifold 142 is located at one end of the furcating heat exchanger 140. The manifold includes four holes 143, 145, 147, 149 including two inlets, one for each fluid and two outlets, one for each fluid. The manifold 142 may further comprise additional fluid connections or may separate the fluid additionally by utilizing more headers. Within holes 143, 145, 147, 149, the features of the header 146, 148 may be seen. For example, through holes 143, 147 are inlet and outlet holes for one of the headers 146, 148. In the other holes 145, 149 are inlet and outlet holes for the other of the headers 146, 148 are shown.

The present embodiments provide two desirable but unexpected results. First, the cross-sectional area for the fluid to flow remains constant during the straight, diverging/furcating, and converging portions, thus irreversible losses due to flow velocity change is limited, if at all an issue. Second, the shapes of the flow passages for each fluid may be varied in cross-sectional area throughout a given fluid domain as needed to optimize for various factors such as flow rate, pressure drop, heat exchange and volume required for the heat exchanger.

The foregoing description of structures and methods has been presented for purposes of illustration. It is not intended to be exhaustive or to limit the invention to the precise steps and/or forms disclosed, and obviously many modifications and variations are possible in light of the above teaching. Features described herein may be combined in any combination. Steps of a method described herein may be performed in any sequence that is physically possible. It is understood that while certain embodiments of methods and materials have been illustrated and described, it is not limited thereto and instead will only be limited by the claims, appended hereto.

The invention claimed is:

1. A heat exchanger comprising:

a plurality of unit cells, each unit cell comprising:

a unit cell first portion including a plurality of first furcated flow passages through which a first fluid flows, the plurality of first furcated flow passages including a plurality of first inbound flow passages and a plurality of first outbound flow passages;

a unit cell second portion including a plurality of second furcated flow passages through which a second fluid flows, the plurality of second furcated flow passages including a plurality of second inbound flow passages and a plurality of second outbound flow passages; and a solid domain, the unit cell first portion and the unit cell second portion positioned at opposite sides of the solid domain, the solid domain separating the first fluid from the second fluid, wherein the plurality of first furcated flow passages of the unit cell first portion is intertwined with the plurality of second furcated flow passages of the unit cell second portion on opposite sides of the solid domain to provide heat transfer, wherein planar surfaces of the plurality of first furcated flow passages extending perpendicular to one another and planar surfaces of the plurality of second furcated flow passages extending perpendicular to one another are in contact with opposite planar surfaces of the solid domain, wherein the unit cell first portion and the unit cell second portion have the same cross-sectional area.

2. The heat exchanger of claim 1, wherein each of the plurality of first outbound flow passages extend from at least one of the plurality of first inbound flow passages at a 90 degree angle.

3. The heat exchanger of claim 1, wherein each of the plurality of second outbound flow passages extend from at least one of the plurality of second inbound flow passages at a 90 degree angle.

4. The heat exchanger of claim 1, wherein the unit cell first portion includes three first inbound flow passages and three first outbound flow passages.

5. The heat exchanger of claim 4, wherein the unit cell second portion includes three second inbound flow passages and three second outbound flow passages.

6. The heat exchanger of claim 5, wherein intersections of walls of the solid domain define intersections of the second fluid where there are either two second inbound flow passages and one second outbound flow passage or, alternatively, two second outbound flow passages and one second inbound fluid flow passage.

7. The heat exchanger of claim 1, wherein the plurality of first furcated flow passages changes a direction of flow of the first fluid, and the plurality of second furcated flow passages changes a direction of flow of the second fluid.

8. The heat exchanger of claim 7, wherein the direction changes reduce a thermal boundary layer within the plurality of first furcated flow passages and the plurality of second furcated flow passages.

9. The heat exchanger of claim 1, wherein the heat exchanger is at least one of a fluid-to-fluid heat exchanger or a liquid-to-liquid heat exchanger.

10. The heat exchanger of claim 9, wherein the liquid-to-liquid heat exchanger includes at least one of an oil-to-oil heat exchanger or an oil-to-fuel heat exchanger.

11. The heat exchanger of claim 9, wherein the fluid-to-fluid heat exchanger includes at least one of a liquid-to-gas heat exchanger or a gas-to-gas heat exchanger.

12. The heat exchanger of claim 1, wherein the intertwined plurality of first furcated flow passages and the plurality of second furcated flow passages define a pattern promoting contact with the solid domain.

13. The heat exchanger of claim 1, wherein the heat exchanger includes a material selected from the group consisting of aluminum, titanium alloy, and aluminum alloy.

14. A heat exchanger comprising:

a manifold;

a heat exchanger core extending from the manifold; and a plurality of unit cells provided within the heat exchanger core, each unit cell comprising:

a unit cell first portion including a plurality of first furcated flow passages through which a first fluid flows, the plurality of first furcated flow passages including a plurality of first inbound flow passages and a plurality of first outbound flow passages;

a unit cell second portion including a plurality of second furcated flow passages through which a second fluid flows, the plurality of second furcated flow passages including a plurality of second inbound flow passages and a plurality of second outbound flow passages; and a solid domain, the unit cell first portion and the unit cell second portion positioned at opposite sides of the solid domain, the solid domain separating the first fluid from the second fluid, wherein the plurality of first furcated flow passages of the unit cell first portion is intertwined with the plurality of second furcated flow passages of the unit cell second portion on opposite sides of the solid domain to provide heat transfer, wherein planar surfaces of the plurality of first furcated flow passages extending perpendicular to one another and planar surfaces of the plurality of second furcated flow passages extending perpendicular to one another are in contact with opposite planar surfaces of the solid domain, wherein the unit cell first portion and the unit cell second portion have the same cross-sectional area.

15. The heat exchanger of claim 14, wherein:

the unit cell first portion includes three first inbound flow passages and three first outbound flow passages;

the unit cell second portion includes three second inbound flow passages and three second outbound flow passages; and intersections of walls of the solid domain define intersections of the second fluid where there are either two second inbound flow passages and one second outbound flow passage or, alternatively, two second outbound flow passages and one second inbound fluid flow passage.

16. The heat exchanger of claim 14, wherein:

the plurality of first furcated flow passages changes a direction of flow of the first fluid, and the plurality of second furcated flow passages changes a direction of flow of the second fluid; and the direction changes reduce a thermal boundary layer within the plurality of first furcated flow passages and the plurality of second furcated flow passages.

* * * * *